United States Patent [19]

Olson

[11] 3,990,627

[45] Nov. 9, 1976

[54] Z-FOLD ADHESIVE STRIPE CLOSURE FOR BAGS

[75] Inventor: Robert H. Olson, Pittsford, N.Y.

[73] Assignee: Mobil Oil Corporation, New York, N.Y.

[22] Filed: Aug. 27, 1975

[21] Appl. No.: 608,320

Related U.S. Application Data

[62] Division of Ser. No. 445,364, Feb. 25, 1974, abandoned.

[52] U.S. Cl. ..... 229/62; 206/260; 229/80

[51] Int. Cl.[2] ..... B65D 33/20

[58] Field of Search ..... 229/62, 66, 80; 150/7; 206/260, 813

[56] References Cited

UNITED STATES PATENTS

| | | | |
|---|---|---|---|
| 2,367,440 | 1/1945 | Schieman | 229/80 |
| 2,384,223 | 9/1945 | Wilbur | 229/80 |
| 3,070,280 | 12/1962 | Richmond | 229/62 |
| 3,309,007 | 3/1967 | Rosenberg et al. | 229/62 |
| 3,310,225 | 3/1967 | Hobut et al. | 229/62 |
| 3,510,052 | 5/1970 | Ruda | 229/62 |
| 3,519,197 | 7/1970 | Campbell | 229/66 |
| 3,717,244 | 2/1973 | Smith | 229/66 |
| 3,811,613 | 5/1974 | Harrison | 229/62 |

*Primary Examiner*—William Price
*Assistant Examiner*—Bruce H. Bernstein
*Attorney, Agent, or Firm*—Charles A. Huggett; James D. Tierney

[57] ABSTRACT

An adhesive closure for bags, such as sandwich bags for example, comprising an adhesive stripe located adjacent the open mouth portion of the bag. The adhesive stripe is covered until ready for use by the upper portion of the bag's front wall whereby upward displacement of the front wall exposes the adhesive stripe for sealing the upper portion of the bag walls together.

1 Claim, 6 Drawing Figures

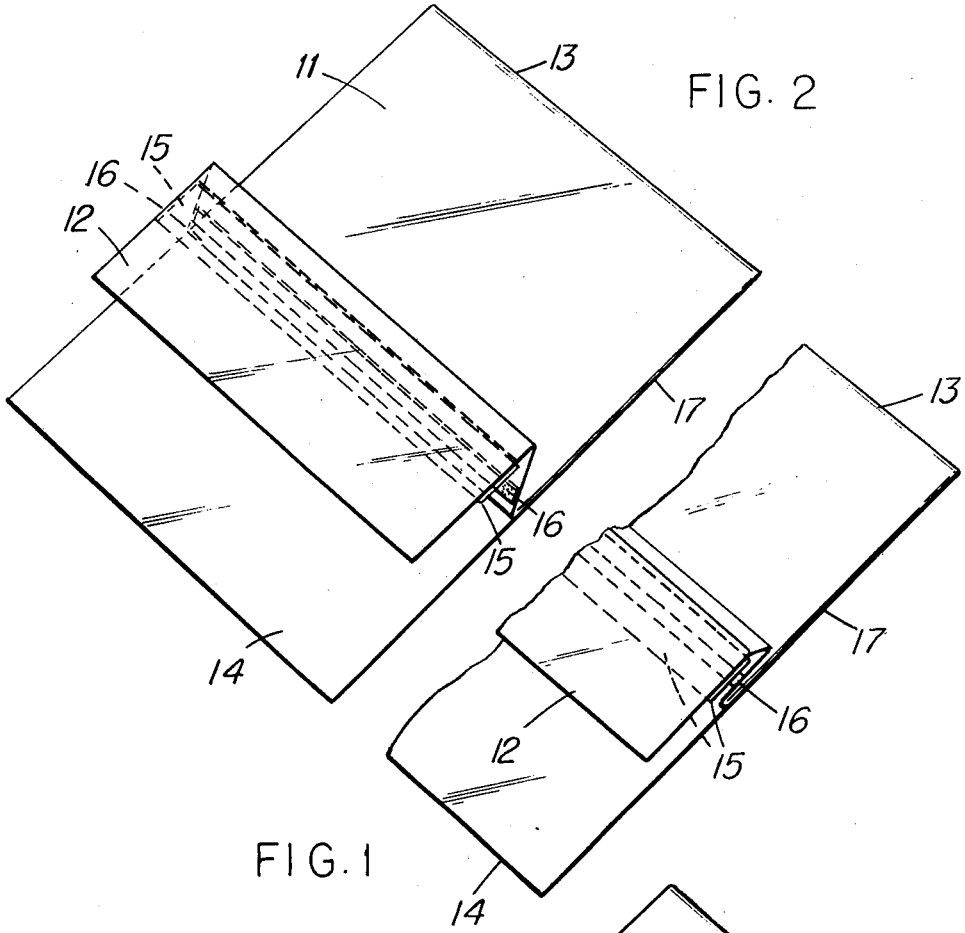
FIG. 2
FIG. 1
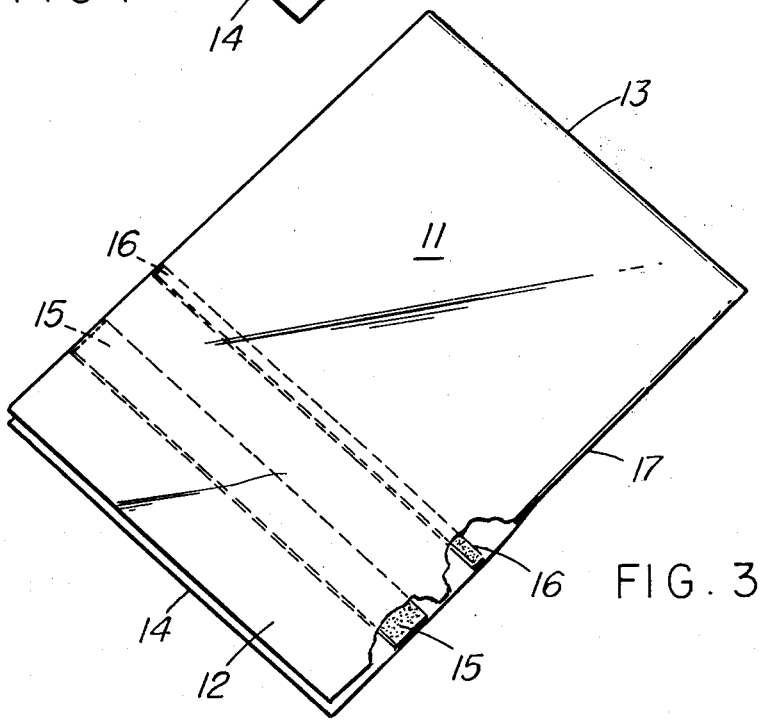
FIG. 3

FIG.4
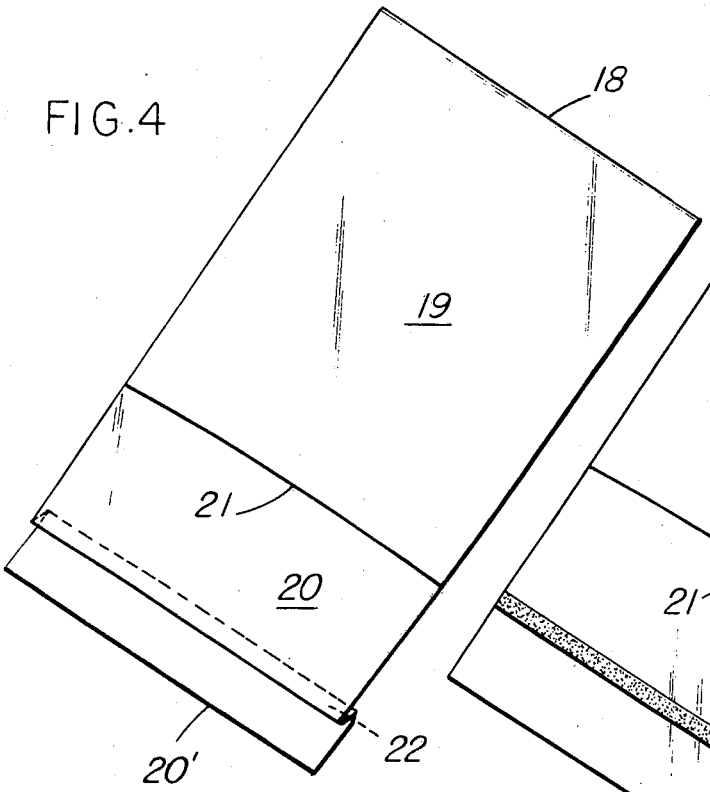
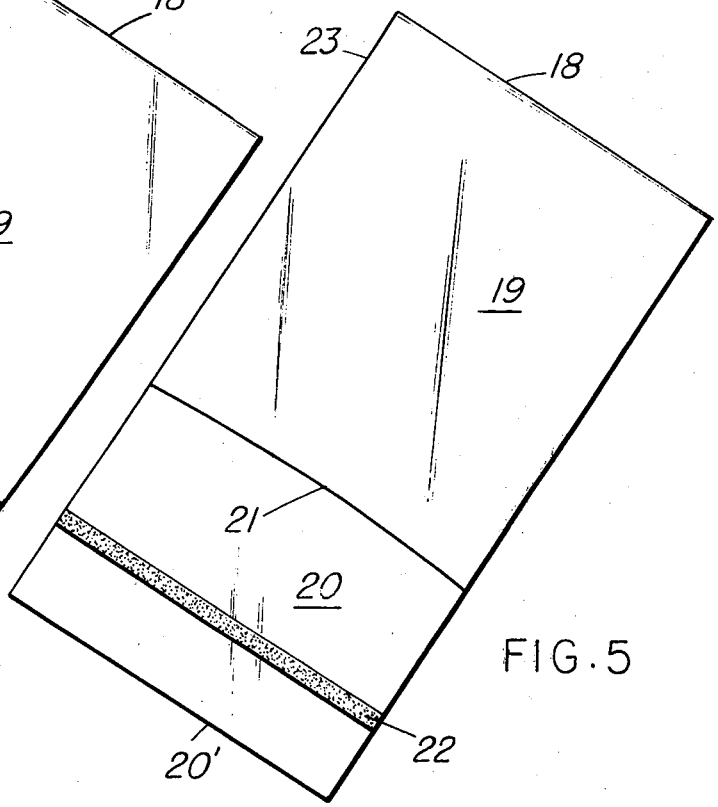
FIG.5
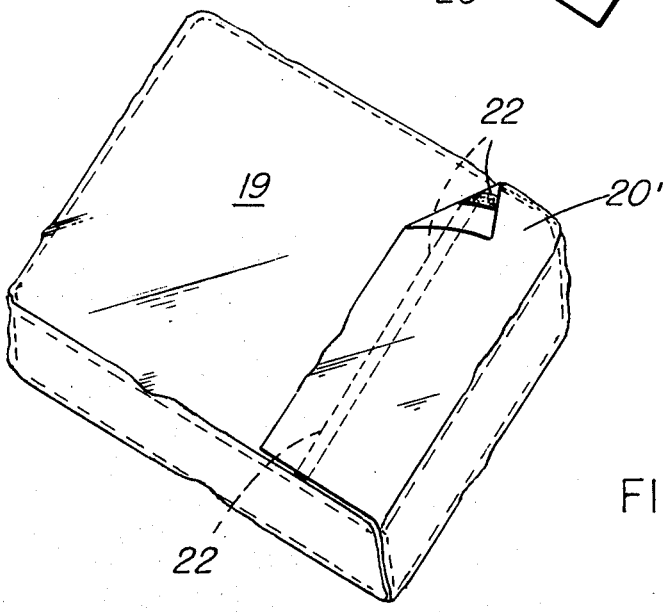
FIG.6

Z-FOLD ADHESIVE STRIPE CLOSURE FOR BAGS

This is a Division of application Ser. No. 445,364, filed Feb. 25, 1974, now abandoned.

BACKGROUND OF THE INVENTION

1. Field of the Invention

The present invention relates to closure arrangements for plastic bags wherein the closure device forms an integral part of the bag structure itself. The closure means comprises an adhesive stripe which is located on a front wall flap adjacent the bag mouth. The adhesive stripe is protected until ready for use by folding a portion of the front wall flap back upon itself thereby protectively covering said adhesive stripe until it is desired to close the bag mouth. Adhesive closure of the bag is effected by displacement of the flap to expose the adhesive stripe and subsequently sealing the bag by pressing the adhesive stripe against the inner surface of the bag back wall.

2. Brief Description of the Prior Art

In the past, numerous closure arrangements have been proposed and employed as closure devices for securing plastic bags in a closed condition. Such devices include rubber bands or so-called twist-ties, paper or plastic coated lengths of wire, which are fastened around the gathered and twisted neck of a plastic bag to secure it in closed condition. An obvious disadvantage of such closure devices is that they do not form an intergral part of the bag structure and hence, may not in many instances be readily accessible when it is desired to effect closure of the bag. Another closure arrangement for plastic bags which has been employed in the past, without significant commercial success, is the employment of an exposed and unprotected adhesive stripe adjacent the open mouth of such bag structures. Such an arrangement presented many drawbacks. When such bags were packaged within a dispensing carton either in continuous roll form or individually adjacent to one another, the bags had a tendency to stick to one another as well as to exterior objects following dispensing of individual bags from the container, thus making it difficult to use the bags. Also, the adhesives necessarily were relatively non-aggressive in an attempt to alleviate such problems thereby making the closures insecure.

SUMMARY OF THE INVENTION

The present invention overcomes the prior art disadvantages and improves the closure arrangements for plastic bags by providing a closure means which is an integral part of the bag structure. The bag structures in accordance with the present invention comprise a front wall and a rear wall joined together along their bottom edges and along the major portion of their opposite longitudinal edges. The bag has an open mouth portion characterized by having a flap member which is an extension of the bag front wall, the edges of the flap member being unattached to the upper portion of the bag rear wall. The front wall flap is folded back upon itself in a "Z-fold" configuration, a portion of said folded over flap bearing against an adhesive stripe which extends across the inner surface of the flap. To close the open mouth of the bag after loading with a product the front flap is displaced upwardly thereby exposing the adhesive stripe which is now brought into pressure engagement with the inner surface of the bag rear wall.

In another embodiment of the bag closure arrangement of the present invention a stiffening member, e.g. a release tape, is permanently secured to the inner surface of the bag's front wall flap whereby when the flap is folded back upon itself, the release tape is brought into protective covering relationship with the adhesive stripe located on the inner surface of the front wall flap. Upward displacement of the front flap causes the release tape to easily peel from the adhesive stripe exposing it for sealing. The release tape remains adhered to the upper portion of the flap acting as a stiffening member for the bag front wall to facilitate the manual or automatic loading of product into such bags.

In still a further embodiment of the sealable bag structures of the present invention, there are provided bag configurations comprising two superimposed front and rear wall members. The walls are integrally joined together along their bottom and side edges and open along their top edge. The upper edge of the rear wall extends upwardly and terminates above the upper edge of the front wall thereby forming a rear wall-bag closure flap. The rear wall flap carries a pressure sensitive adhesive stripe disposed transversely across the width of the rear wall flap. The adhesive stripe is protected, until it is ready for use, by folding a portion of the rear wall flap back upon itself thereby covering the adhesive stripe. Upward displacement of the rear wall flap exposes the adhesive stripe whereby when the rear wall bag flap is folded down into contact with the outer surface of the bag front wall the flap is held in place by means of the pressure sensitive adhesive stripe. The sealable bags of the present invention may be packaged as individual bags or, conversely, as a continuous roll of bags interconnected by a tear line for ease of separation of an individual bag from the continuous roll.

The novel aspects and advantages of the bag closure arrangements of the present invention will be more clearly understood from the following description of specific embodiments when read in conjunction with the accompanying drawings.

BRIEF DESCRIPTION OF THE DRAWINGS

FIG. 1 is a fragmentary perspective view of one of the bag construction embodiments of the present invention, in an open position.

FIG. 2 is a perspective view of the bag shown in FIG. 1 as the bag closing operation has begun.

FIG. 3 is a fragmentary perspective view of the bag structure, shown in FIGS. 1 and 2, in a closed and sealed condition.

FIG. 4 is a perspective view of another embodiment of a bag construction in accordance with the present invention.

FIG. 5 is a perspective view of the bag shown in FIG. 1 which has been prepared for sealing.

FIG. 6 is a view of the bag structure, as shown in FIGS. 4 and 5, in a closed condition, enveloping a sandwich for illustrative purposes.

DESCRIPTION OF SPECIFIC EMBODIMENTS

As illustrated in FIGS. 1 through 3 of the drawings a specific bag structure of the present invention comprises a front wall 11 joined to a back wall 14 along a bottom fold line 13 and along opposite longitudinal heat seal lines 17. The upper portion 12 of front wall 11 is formed by a front wall flap 12 the longitudinal edges of which are not attached to the opposed upper portion of back wall 14.

The inner surface of flap 11 is provided with a transversely extending pressure sensitive adhesive 16. The adhesive stripe is protectively encased by front wall flap 12 being folded back upon itself, as shown in FIG. 1, to cover the adhesive stripe until it is desired to adhesively close the mouth of the bag. This is accomplished by simply drawing flap 12 upwardly which causes the "Z-fold" to unfold whereby adhesive stripe 16 is exposed and subsequently brought into pressure contact with the upper portion of back wall 14.

Suitable adhesive materials which may be employed include acrylic resins, natural and synthetic based rubbers, and polyvinyl ether based pressure sensitive adhesives.

In particular instances it may be desirable to protect the inner flap surface 12 from direct contact with adhesive stripe 16. Accordingly, to provide for ease of separation of folded over flap 12 from adhesive stripe 16 a strip of release material 15 may be employed.

Release materials which may be commonly employed generally comprise various types of paper impregnated, typically, with silicone based compounds. Also various plastics, for example high density polyethylene, have inherent release properties which make them suitable for use as a protective cover in this application. Surface treatment of the bag film by corona discharge or chemical treatment will also make the bag flap 20 more receptive to adhesion by the adhesive.

As illustrated in FIGS. 1, 2 and 3 the release tape 15 is permanently secured to the inner surface of flap 12 whereby when flap 12 is folded back upon itself, tape 15 is brought into adhesive contact with adhesive stripe 16. Such an arrangement results in ease of separation of the front flap from the adhesive stripe 16 when the flap 12 is pulled upwardly during the sealing operation hereinabove described. Further the strip of release tape 15 has a stiffening effect in the bag mouth area which facilitates ease of handling the bag during closing and reopening operations.

FIGS. 4, 5 and 6 illustrate another embodiment of the bag closure arrangement of the present invention. The bag construction is of the side seal variety having a front wall 19 and a rear wall 20. The bag walls are joined together by longitudinal heat seams 23 and bottom crease (fold line) 18, having an open mouth at 21.

It will be noted that the upper edge of rear wall 20 extends beyond the upper edge of front wall 19, thereby forming closure flap 20'. Closure flap 20' is characterized by having adhesive stripe 22 extending longitudinally across the flap. As shown in FIG. 4 the adhesive stripe 22 is protected, until ready for use, by flap member 20 being folded upon itself at 23 in a manner as hereinbefore described, i.e. a "Z-fold" configuration which covers the adhesive stripe 22 until it is desired to seal the bag. As shown in FIG. 5 as flap 22 is drawn upwardly, fold 23 is unfolded or opened thereby exposing adhesive stripe 22. After an object has been inserted into the open mouth 21 of the bag, e.g. a sandwich, flap 20' is folded down to overlie the upper portion of front wall 19 and the pressure sensitive adhesive stripe 22 seals the flap against front wall 19 as shown in FIG. 6.

Although the present invention has been described with preferred embodiments, it is to be understood that modifications and variations may be resorted to without departing from the spirit and scope of this invention as those skilled in the art will readily understand.

What is claimed is:

1. A thermoplastic bag comprising a front wall and a rear wall, said walls being joined together along the major portion of their opposite longitudinal edges and bottom, an open mouth portion adjacent to the top edge of said front wall, said open mouth portion of said bag being characterized by a flap member which is an extension of the front bag wall and having longitudinal edges which are not joined to the upper edges of said rear wall, said flap having a stripe of pressure sensitive adhesive which extends transversely across the lower portion of said flap on its inner surface, the inner upper surface of said flap being further characterized by having a stiffening tape spaced from said adhesive said tape being permanently adhered to said flap, said space between the adhesive and tape being utilized to fold the flap back upon itself, said stiffening tape protectively covering said adhesive stripe when said flap is folded upon itself prior to bag closure whereby when it is desired to adhesively close said bag said flap is displaced upwardly thereby exposing said adhesive stripe for adhesively closing said open bag mouth and said stiffening tape providing increased rigidity to said bag mouth for ease of loading product into said bag.

* * * * *